US008733910B1

(12) United States Patent
Wilson et al.

(10) Patent No.: US 8,733,910 B1
(45) Date of Patent: May 27, 2014

(54) UNITARY MULTIPLE SEAL MECHANISM

(71) Applicant: Hewlett-Packard Development Company, L.P., Houston, TX (US)

(72) Inventors: Rhonda L. Wilson, Monmouth, OR (US); Peter R. Stokes, Monroe, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/753,805

(22) Filed: Jan. 30, 2013

(51) Int. Cl.
*B41J 2/175* (2006.01)

(52) U.S. Cl.
USPC ..... 347/85

(58) Field of Classification Search
USPC ..... 347/84, 85, 86, 87
See application file for complete search history.

(56) References Cited

U.S. PATENT DOCUMENTS

| | | | | |
|---|---|---|---|---|
| 4,074,284 | A * | 2/1978 | Dexter et al. | 347/49 |
| 4,568,954 | A * | 2/1986 | Rosback | 347/86 |
| 5,359,356 | A * | 10/1994 | Ecklund | 347/86 |
| 5,856,840 | A * | 1/1999 | Barinaga et al. | 347/86 |
| 6,170,939 | B1 | 1/2001 | Ujita et al. | |
| 6,280,024 | B1 | 8/2001 | Miyazawa et al. | |
| 6,652,081 | B2 | 11/2003 | Shimizu | |
| 6,805,434 | B2 | 10/2004 | Hayashi et al. | |
| 6,854,836 | B2 | 2/2005 | Ishinaga et al. | |
| 7,559,634 | B2 * | 7/2009 | Miyazawa | 347/84 |

FOREIGN PATENT DOCUMENTS

| | | | |
|---|---|---|---|
| CN | 201687427 | U | 12/2010 |
| WO | WO-98/15766 | A1 | 4/1998 |
| WO | WO-01/00416 | A1 | 1/2001 |

* cited by examiner

*Primary Examiner* — Anh T. N. Vo

(57) ABSTRACT

A unitary multiple seal mechanism includes a tubular sealing member having a longitudinal axis, and a second sealing member radially displaced from the tubular sealing member and connected to the tubular sealing member by a flexible connection.

11 Claims, 4 Drawing Sheets

UNITARY MULTIPLE SEAL MECHANISM

BACKGROUND

Printers for forming images on print media include numerous parts, some of which are very small. Consequently, the manufacturing of printers can be labor intensive and is susceptible to inadvertently omitting small parts from the assembled printer, which increases the defect rate.

BRIEF DESCRIPTION OF THE DRAWINGS

For a detailed description of various examples, reference will now be made to the accompanying drawings in which.

NOTATION AND NOMENCLATURE

Figure 1:
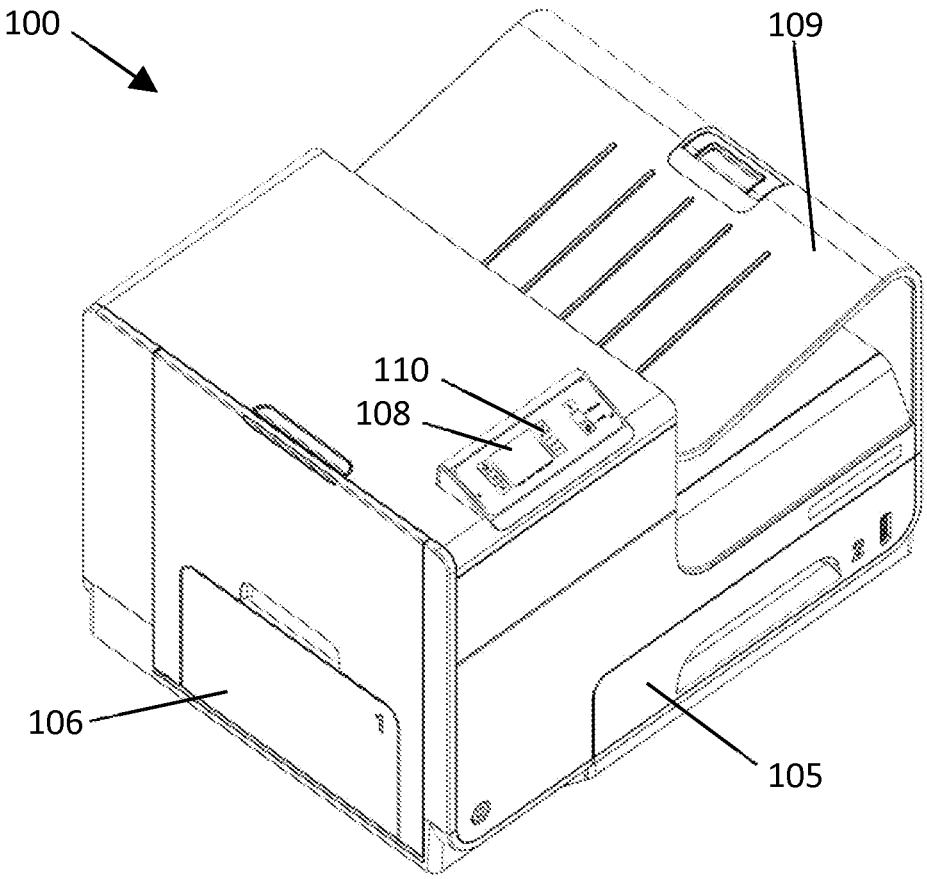
FIG. 1 shows a printing system in accordance with at least one example.

Certain terms may be used throughout the following description and claims to refer to particular system components. Companies and people may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, like or identical reference numerals may be used to identify equivalent or similar elements.

References made regarding a direction, for example upward, leftward, and clock-wise, and references made regarding a position, such as bottom, top, or side, are made for the purpose of clarification and pertain to the orientation of an object as shown. If the object were viewed from another orientation or were mounted in a different orientation, it may be appropriate to describe direction or position using an alternate term.

In addition, as used herein, including the claims, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

DETAILED DESCRIPTION

Figure 2:
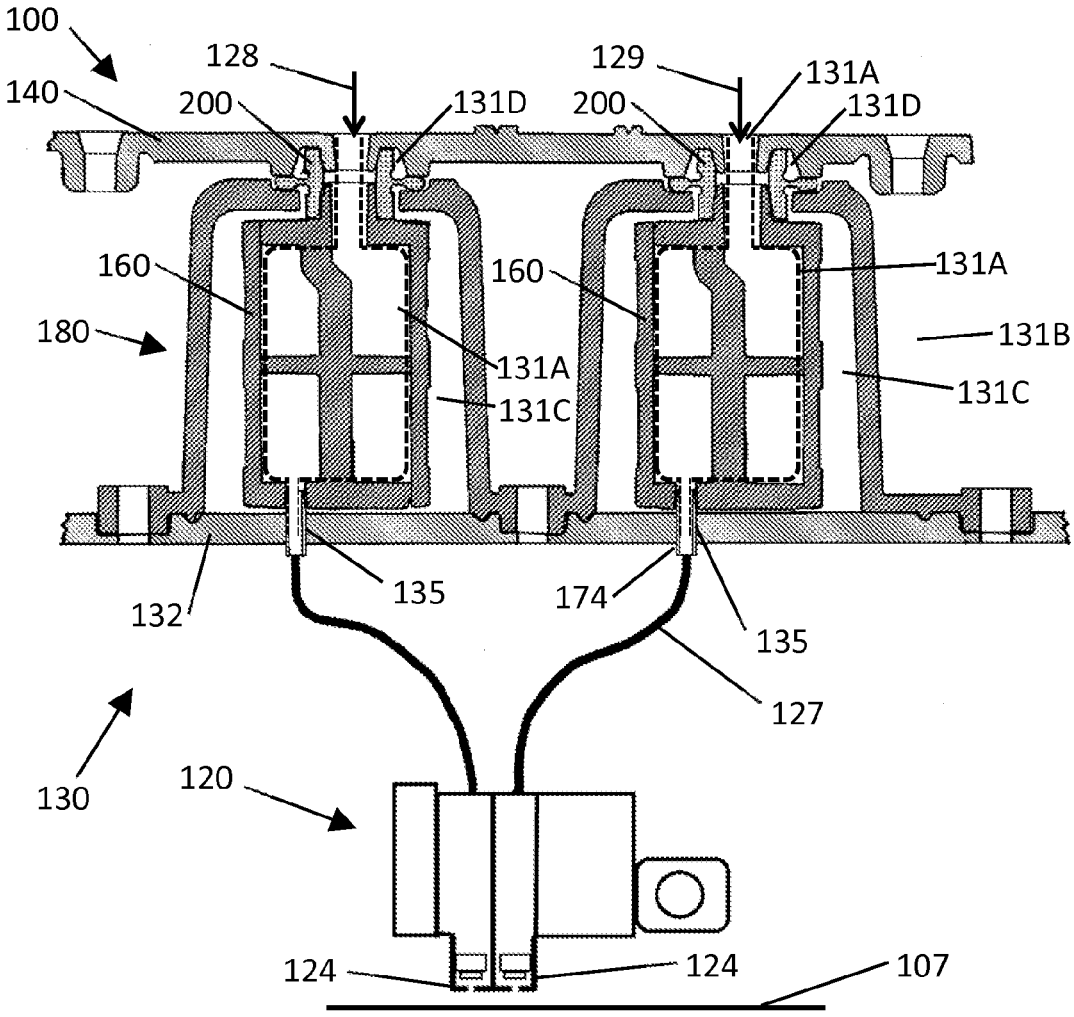
FIG. 2 shows a schematic, partially in cross-section, of the printing system of FIG. 1 in accordance with at least one example.

FIGS. 1 and 2 show an example of a printer system. Printer system 100 includes a print media tray 105, a fluid delivery system 130 including a unitary multiple seal mechanism 200, an image forming mechanism 120 to form an image on print media, and an output tray 109. When formed, the image may include text and graphics. Printer system 100 also includes an externally loading print media tray 106 having a door that rotates downward. In various implementations, the printer system 100 is capable of bi-directional movement of print media or duplex printing, i.e., printing on two sides of the same piece of print media. The printer system 100 further includes a user display 108 to provide visual feedback and information to the user of the printer and includes user input controls 110 (e.g., buttons) that can be activated by the user to cause various actions to be performed by the printer system 100. Printer system 100 may also be called "printer" 100. In various implementations, image forming mechanism 120 may be a print-head, a page-wide print array, or another suitable mechanism.

In the example of FIG. 2, image forming mechanism 120 comprises a print nozzle 124 to deliver liquid (e.g., ink) to a piece of print media 107. The schematic of FIG. 2 shows two nozzles 124, as is useful for printing with, for example, two colors of ink. In practice, printer 100 or image forming mechanism 120 may have any practical number of nozzles 124. For example, printer 100 may have four nozzles 124, one for each of the colors black, cyan, magenta, and yellow.

Fluid delivery system 130 includes the unitary multiple seal mechanism 200, a base plate 132 with a fluid coupling through-bore 135, a manifold plate 140, a fluid transfer mechanism 160 coupled between plates 132, 140, and a housing vessel 180 coupled between plates 132, 140 and surrounding the fluid transfer mechanism 160. FIG. 2 illustrates the fluid delivery system 130 having two fluid transfer mechanisms 160 each contained within the housing vessel 180, further contained by base plate 132, and coupled to a unitary multiple seal mechanism 200. In practice, fluid delivery system 130 may have any practical number of fluid transfer mechanisms 160, unitary multiple seal mechanisms 200, and housing vessels 180. In various instances, a housing vessel 180 contains only one fluid transfer mechanism 160 or contains more than two fluid transfer mechanisms 160.

In the example of FIG. 2, each fluid transfer mechanism 160 functions at least in part as a pressure regulator and is coupled to, and in fluid communication with, the image forming mechanism 120 and a nozzle 124. The coupling between the pressure regulator and the image forming mechanism 120 is implemented, at least in part, by a fluid connector 174 and a fluid supply hose 127. In various implementations, fluid transfer mechanism 160 may include additional devices, such as a filter, a flow meter, a pressure transducer, a temperature transducer, or a pump, for example, with or without having the functionality of a pressure regulator. Various implementations may exclude base plate 132, and image forming mechanism 120 may couple more directly to fluid transfer device 160 or may couple to housing vessel 180.

Figure 3:
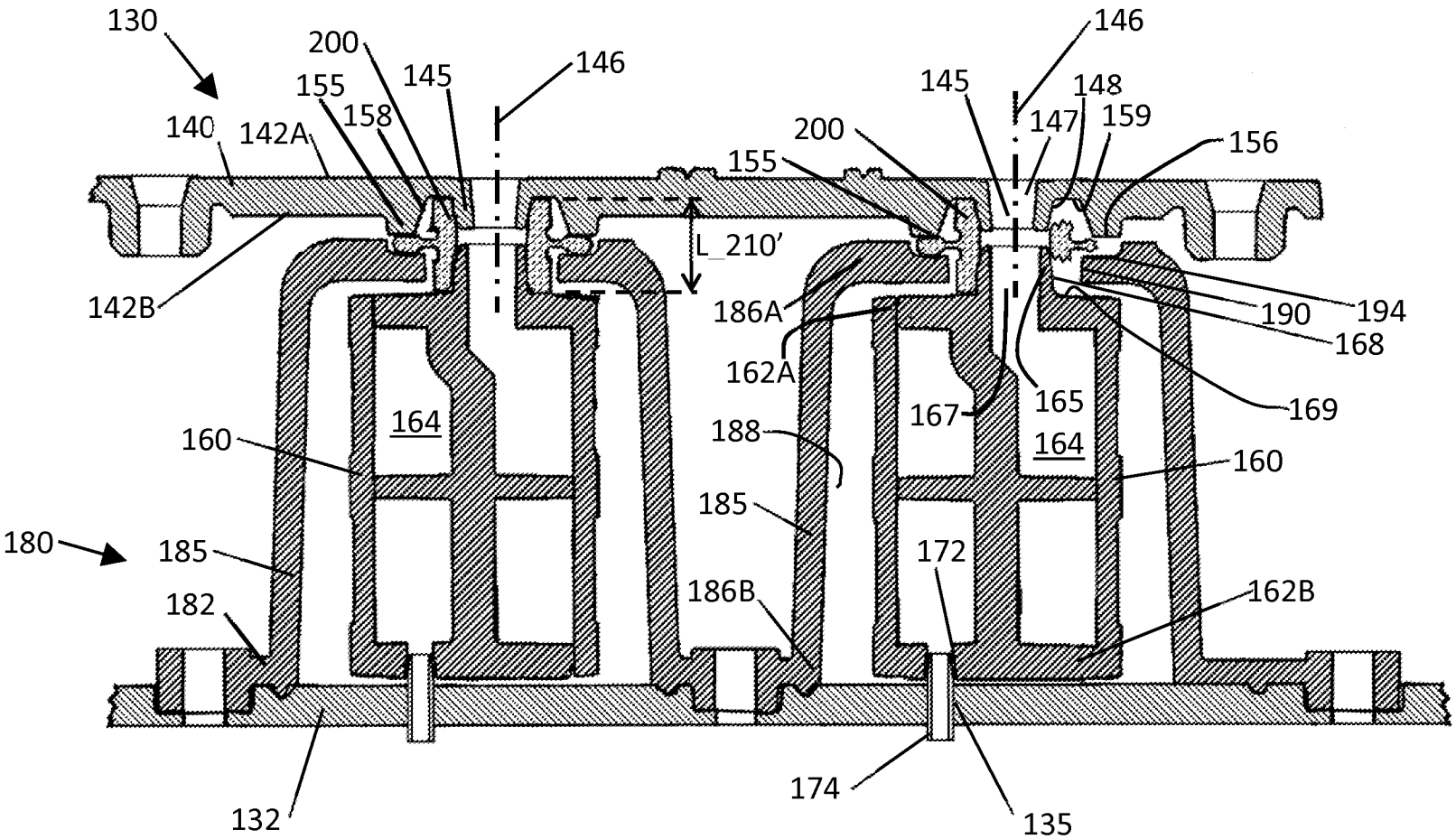
FIG. 3 shows a side view in cross-section of a fluid delivery system in accordance with at least one example.

FIG. 3 presents a closer view of fluid delivery system 130. As shown, manifold plate 140 includes a first or upper surface 142A, a second or lower surface 142B, a fluid exchange nipple 145 extending downward from lower surface 142B, an annular boss 155 surrounding nipple 145, and an annular recess 158 disposed between nipple 145 and annular boss 155. The example of FIG. 3 illustrates a manifold plate 140 with two nipples 145, each nipple associated with a boss 155 and a recess 158. In practice, manifold plate 140 may have any practical number of these features. The distal end of annular boss 155 includes a generally planar, radially-extending surface 156. In fluid delivery system 130, the surface 156 of the manifold plate 140 engages and seals against a portion of unitary multiple seal mechanism 200; therefore, surface 156 is an example of a manifold sealing surface and may be called a manifold sealing surface 156. A generally planar, radially-extending surface 159 is disposed at the inner end of recess 158 and around the base of nipple 145. The surface 159 engages and seals against a portion of unitary multiple seal mechanism 200; therefore, surface 159 is another example of a manifold sealing surface and may be called manifold sealing surface 159. Surface 156 and surface 159 may share a similar shape or may each have different shapes in various implementations. On the right side of FIG. 3, unitary multiple seal mechanism 200 is shown in a broken view to clarify other features of fluid delivery system 130.

Fluid exchange nipple 145 of manifold plate 140 is generally tubular and includes a longitudinal axis 146, a fluid passage 147, and an outer, generally cylindrical surface 148, which engages and seals against a portion of unitary multiple seal mechanism 200. Therefore, the generally cylindrical surface 148 may also be called "manifold nipple sealing surface" 148. More broadly, surface 148 is yet another example of a manifold sealing surface. In this implementation, sealing surface 148 tapers to a smaller outside diameter as it extends further from upper surface 142A.

Fluid transfer mechanism 160, which in this example includes a pressure regulator, includes first or upper end 162A, a second or lower end 162B opposite end 162A, an internal chamber 164, a generally tubular fluid exchange nipple 165 at upper end 162A, and a fluid exit passage 172 extending through lower end 162B from chamber 164. Fluid transfer mechanism 160 also includes a generally planar, radially-extending surface 169 located on upper end 162A around the base of nipple 165. The surface 169 engages and seals against a portion of unitary multiple seal mechanism 200; therefore, surface 169 is a sealing surface for mechanism 160 and may be called a mechanism sealing surface 169.

Nipple 165, chamber 164, and fluid exit passage 172 are in fluid communication so that a fluid may enter, travel through, and exit fluid transfer mechanism 160. Internal chamber 164, which may also be called fluid passage 164, includes multiple sub-chambers, and some chambers are interconnected for fluid communication. In other embodiments, chamber 164 may include a single chamber or flow passage. Nipple 165 includes a fluid inlet passage 167 and an outer, generally cylindrical sealing surface 168. Surface 168 is another example of a mechanism sealing surface. In at least one embodiment, the contour of outer, sealing surface 168 is similar to or the same as the contour of sealing surface 148 on the manifold's fluid exchange nipple 145. A fluid connector 174, shown in FIGS. 2 and 3 as a tube, couples to exit passage 172 and extends through fluid coupling through-bore 135 in base plate 132. Seals are formed between fluid connector 174 and fluid transfer mechanism 160 as well as between fluid connector 174 and base plate 132. Fluid connector 174 may be slid, threaded, press-fit, bonded, or installed by any suitable means. In various implementations, exit passage 172 includes an integral nipple 165 that replaces the separate fluid connector 174. In various implementations, the fluid connector 174 or the nipple 165 at exit passage 172 couples to another unitary multiple seal mechanism 200 or an O-ring (not shown) positioned near lower end 162B of fluid transfer mechanism 160.

Continuing to reference FIG. 3, housing vessel 180 includes a base 182 and two domes 185 extending from a base 182. Each dome 185 includes a first or upper end 186A, a second or lower end 186B that may be open, an inner chamber 188, and an aperture 190 in upper end 186A, and a generally planar sealing surface 194 surrounding each aperture 190 on the outer surface of upper end 186A. In at least one embodiment, the contour of housing sealing surface 194 is similar to and may be a mirror image of the contour of the manifold sealing surface 156. In various other examples, housing vessel 180 includes one dome 185 or more than two domes 185. In FIG. 3, each dome 185 contains a fluid transfer mechanism 160. In various implementations, a dome 185 may contain any practical number of fluid transfer mechanisms 160.

Figure 4:
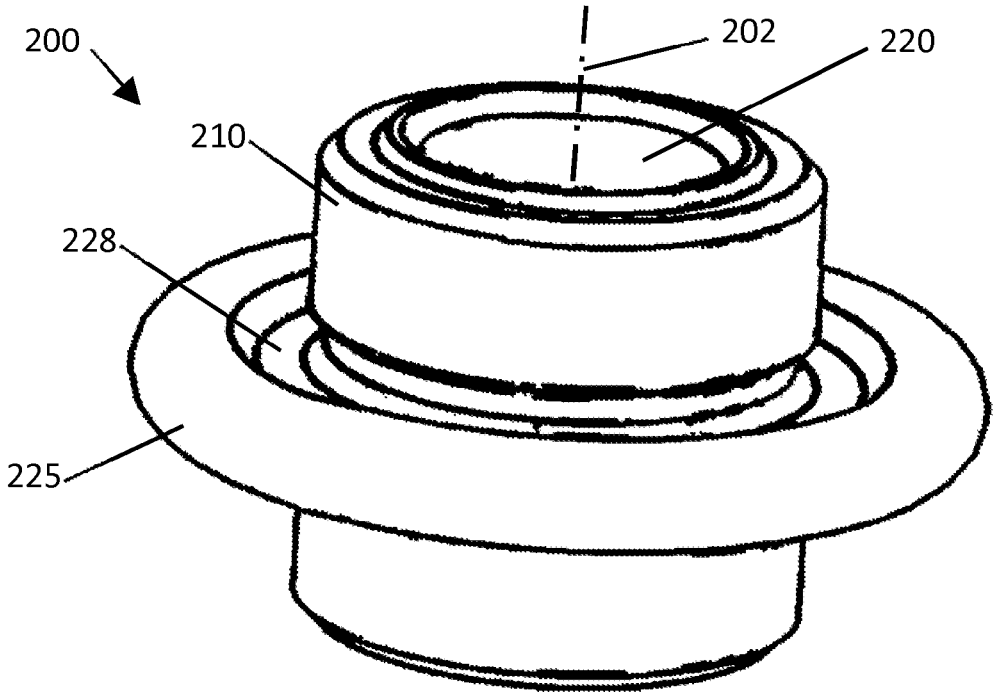
FIG. 4 shows perspective view of a unitary multiple seal mechanism in accordance with at least one example.

Referring to FIG. 4, unitary multiple seal mechanism 200 includes a tubular sealing member 210, passage 220 extending axially through the member 210, a second sealing member 225 radially displaced from the member 210, and a flexible connection 228 extending radially between the member 210 and the second sealing member 225. A longitudinal axis 202 extends through the unitary multiple seal mechanism 200. In this example, second sealing member 225 is annular with a circular cross-section, is positioned outside the member 210, and is generally concentric with member 210. In various other examples, second sealing member 225 is not concentric with member 210.

Figure 5:
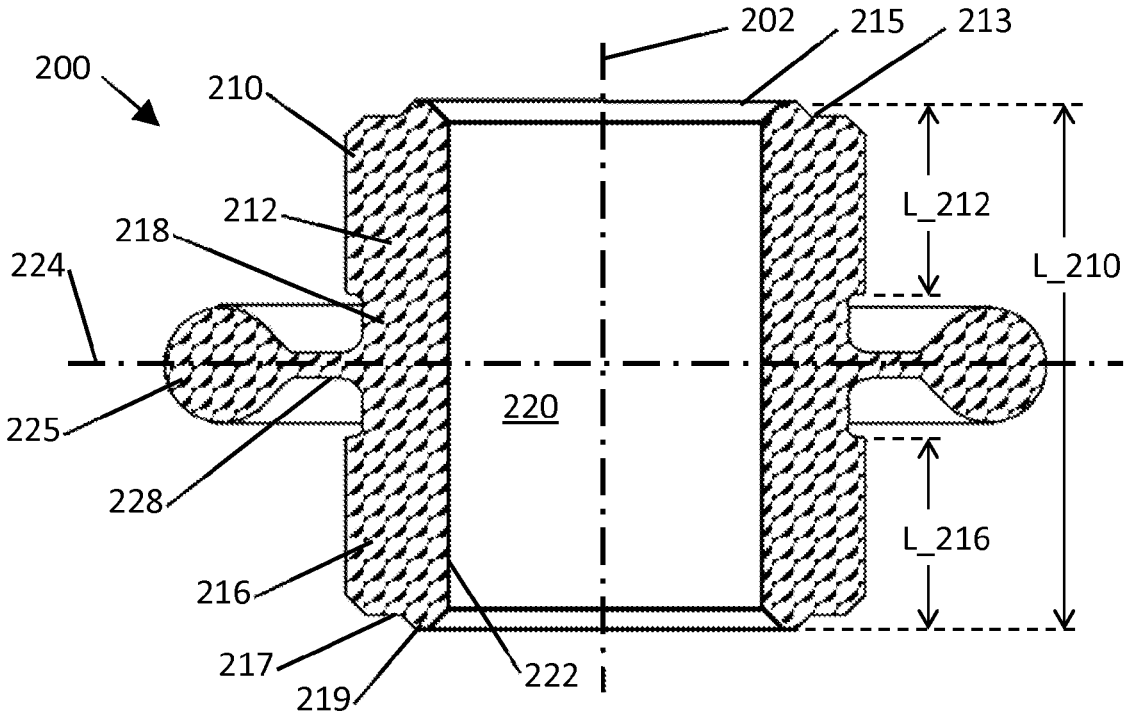
FIG. 5 shows a side view in cross-section of the unitary multiple seal mechanism of FIG. 4 in accordance with at least one example.

Additional details about unitary multiple seal mechanism 200 are presented in FIG. 5. Tubular sealing member 210 which may also be called boot seal 210, includes a first or upper end section 212, a second or lower end section 216 axially displaced from the first end section, and an intermediate section 218 having a smaller outside diameter than the end sections 212, 216 have. Tubular sealing member 210 is characterized by a length of L_210. Upper end section 212 has an axial length L_212 and terminates at a first or upper end surface 213. Lower end section 216 has an axial length L_216 and terminates at a second or lower end surface 217. In the example of FIG. 5, end sections 212 and 216 are similar or identical in shape and size and may have equal outside diameters, equal inside diameters, and equal axial lengths L_212, L_216. Axial passage 220 extends through the first end section, the intermediate section, and the second end section. Axial passage 220 includes inner surface 222 for forming a seal. In the instance of FIG. 5, inner surface 222 is uniformly spaced around axis 202, and axial passage 220 may be a central through-passage in boot seal 210.

End surfaces 213, 217 are annular. End surfaces 213, 217 each include a chamfered, circular lip, i.e., an axial extension, adjacent the two edges of inner surface 222. In particular, upper end surface includes upper lip 215, and lower end surface 217 includes lower lip 219. Flexible connection 228 extends radially outward from the intermediate section 218. Flexible connection 228 and second sealing member 225 may be equidistant from end sections 212, 216 and from end surfaces 213, 217. As shown in the example of FIG. 5, unitary multiple seal mechanism 200 is symmetrical about axis 202 and is symmetrical about a line 224 perpendicular to axis 202 and located equal distant between ends 213 and 217; i.e., seal mechanism 200 exhibits top-to-bottom symmetry.

In various implementations, any of the sections 212, 216, 218 of boot seal 210 may have an outside diameter, an inside diameters, and a length that is greater than equal to or less than the corresponding dimension of another section. In various implementations of a unitary multiple seal mechanism, flexible connection 228 or second sealing member 225 are positioned at any axial location with respect to boot seal 210 and thus may be closer to one of the end surfaces 213, 217. Thus, in various implementations, seal mechanism 200 may lack axially symmetry or may lack top-to-bottom symmetry.

In at least the implementation shown in FIG. 5, flexible connection 228 is axially thinner than second sealing member 225 to provide axial and radial compliance allowing the second sealing member 225 to perform independently from boot seal 210, during or after installation in an assembly such as fluid delivery system 130. As best shown in FIG. 4, flexible connection 228 is solid. However, in other examples, flexible connection 228 includes perforations, spokes, webbing structure, undulations (e.g., folds), foamed material, or another feature that may provide compliance in connection 228.

Unitary multiple seal mechanism 200 may be made from a variety of compliant materials or resilient materials, including these examples: natural rubber, synthetic rubber, which may include ethylene-propylene-diene-monomer (EPDM), silicone, or a thermoplastic elastomer such as Santoprene. The various portions or components of unitary multiple seal mechanism 200, e.g., the boot seal 210, the second sealing member 225, or the flexible connection 228, may be made from the same material or from different materials. For example, in some implementations, flexible connection 228 is made of one resilient material while boot seal 210 or the second sealing member 225 may be made from another resilient material. The boot seal 210, the second sealing member 225, and the flexible connection 228 may be formed simultaneously or may be formed separately and then joined together. In various implementations, the unitary multiple seal mechanism 200 comprises a single, homogeneous resilient material. Unitary multiple seal mechanism 200 and its components may be formed or joined by any suitable process such as a molding process.

Referring again to FIG. 3, in the assembly of fluid delivery system 130, fluid exchange nipple 165 of fluid transfer mechanism 160 generally aligns axially with fluid exchange nipple 145 of manifold plate 140. A length L_210' ("length 210 prime") designates the distance between manifold sealing surface 159 around the base of nipple 145 and mechanism sealing surface 169 around the base of nipple 165. Length L_210' is less than the length L_210 of tubular sealing member 210 (FIG. 5) so that tubular sealing member 210 is axially compressed and conforms to the length L_210' when installed therebetween. In the implementation of FIG. 3, the installed, compressed length L_210' of tubular sealing member 210 is between 15% to 35% less than its uncompressed length L_210. In various implementations, the manifold plate 140 and the fluid transfer mechanism 160 engage and compress the tubular sealing member 210 lengthwise, i.e., axially, by 10% to 40% of the uncompressed length L_210. Lengthwise compressions greater than 40% may be achieved in various other implementations.

The compression of tubular sealing member 210 forces circular lip 215 and, potentially, the remainder of upper end surface 213 into sealing contact with manifold sealing surface 159, forming a "face seal" therebetween. Circular lip 215 may experience a higher contact force than the reminder of upper end surface 213 due to the axial protrusion and the reduced contact area of the lip 215. The compression of tubular sealing member 210 also forces circular lip 219 and the remainder of lower end surface 217 into sealing contact with mechanism sealing surface 169, forming another face seal therebetween. Circular lip 219 may experience a higher contact force than the reminder of lower end surface 217 due to the axial protrusion and the reduced contact area of the lip 219. In this manner, manifold sealing surface 159 and mechanism sealing surface 169 form pair of sealing surfaces that are engaged by the tubular sealing member 210, forming two face seals with the two end surfaces 213, 217. In this example, the pair of sealing surfaces 159, 169 is generally planar.

Also in the assembly of fluid delivery system 130, the manifold sealing surface 156 generally aligns with and faces the housing sealing surface 194, and both surfaces 156, 194 are engaged by second sealing member 225 of unitary multiple seal mechanism 200. Thus, manifold sealing surface 156 and housing sealing surface 194 form another pair of sealing surfaces. In this example, the pair of sealing surfaces 156, 194 is generally planar.

Continuing to consider the assembly that includes manifold plate 140 and transfer mechanism 160 in FIG. 3, manifold nipple sealing surface 148 generally aligns with the nipple sealing surface 168 on the fluid transfer mechanism 160, and both are engaged by the inner surface 222 of unitary multiple seal mechanism 200, creating a seal therebetween in at least some implementations. Thus, nipple sealing surfaces 148, 168 form a pair of sealing surfaces engaged by tubular sealing member 210 of unitary multiple seal mechanism 200. In at least this example, the pair of sealing surfaces 148, 168 is generally cylindrical. In various instances or in various other implementations, manifold nipple sealing surface 148 and nipple sealing surface 168 may engage the inner surface 222 without forming a seal, for example due to a sufficient radial expansion of tubular sealing member 210 that may result from the axial compression of member 210.

Referring again to FIG. 2, in fluid delivery system 130, unitary multiple seal mechanism 200 couples to the manifold plate 140, the fluid transfer mechanism 160, and the housing vessel 180, forming three mutually isolated fluid zones 131A, 131B, 131C. Zone 131A is generally indicated by dashed lines. A forth fluid zone 131D is also formed by unitary multiple seal mechanism 200; however, in some implementations the forth fluid zone 131D is in fluid communication with the third zone 131C and may be considered to be a continuation of third zone 131C. In still other implementations, forth fluid zone 131D may be a continuation of first zone 131A. In the example of FIG. 2, the formation and isolation of various zones 131A, 131B, 131C, 131D is accomplished, in part, by the coupling of base plate 132 to housing vessel 180. Various other implementations, the isolation of zones 131A, 131B, 131C, 131D is accomplished without base plate 132. For example, image forming mechanism 120 may couple more directly to fluid transfer device 160 or may couple to housing vessel 180 forming a seal therebetween.

Fluid transfer mechanisms 160 are isolated from atmospheric zone 131B, at least in part, by housing vessel 180 and the second sealing members 225 of unitary multiple seal mechanisms 200.

Each zone 131A includes a fluid passage 147 in a nipple 145 of manifold plate fluid 140, an axial passage 220 in a sealing member 200, passages 164, 167, 172 of a fluid transfer mechanism 160. Each fluid zone 131A, 131B, 131C, 131D may contain any suitable fluid or suitable combination of fluids, including, for example, air, ink, water, humid air, nitrogen, or a noble gas and may have a pressure greater than, equal to, or less than atmospheric pressure. The pressure of any zone 131A, 131B, 131C, 131D may vary with time and may rise above or sink below atmospheric pressure. In various examples, zone 131A contains ink at a pressure less than atmospheric pressure, zone 131B corresponds to atmospheric air, and zone 131C contains humid air. Atmospheric zone 131B may extend to the volume around nozzles 124. Reduced pressure in zone 131A may reduce the potential for ink to drip unexpectedly from a nozzle 124.

Again considering the printer system 100 on the left side of FIG. 2, a first fluid delivery path 128 includes a fluid passage 147 in a nipple 145 of manifold plate fluid 140, an axial passage 220 in sealing member 200, passages 164, 167, 172 of fluid transfer mechanism 160, a fluid connector 174, a fluid supply hose 127 and passages within image forming mechanism 120 extending through a nozzle 124. A second fluid delivery path 129 is similarly formed and extends through the other nozzle 124. Thus, first fluid delivery path 128 and the second fluid delivery path 129 each include a zone 131A in fluid delivery system 130. A first color of ink from a first ink reservoir or cartridge (not shown) coupled to manifold plate fluid 140 and first fluid delivery path 128 may pass through path 128 to form an image on the piece of print media 107. A second color of ink from a second ink reservoir or cartridge (not shown) coupled to manifold plate fluid 140 and second fluid delivery path 129 may pass through path 129 to form an image on the piece of print media 107.

Fluid delivery system 130 couples to image forming mechanism 120, which in the example of FIG. 2 is accomplished using fluid supply hoses 127.

As indicated in the previous discussion, multiple variations and modifications are possible for the features and systems disclosed herein. Some additional variations and modifications are explained in the follow paragraphs.

In various implementations, a unitary multiple seal mechanism 200 may couple to the exit passage of fluid transfer device 160.

Although, second sealing member 225 is shown in FIGS. 4 and 5 as circular in cross-section like an O-ring, in other implementations the second sealing member may have another cross-sectional shape such as, for example, square, rectangular, or oval. The second sealing member may extend further radially than axially. Alternatively, second sealing member 225 may include a tubular portion, extending further in the axial direction than in the radial direction.

In various implementations of a unitary multiple seal mechanism, second sealing member 225 is positioned inside boot seal 210 with flexible connection 228 extending radially inward from the surface 222 to the member 225.

Several examples of sealing surfaces have been described or illustrated herein. Examples include surfaces 148, 156, 168, 194, 222 and the outer surface of second sealing member 225. In various implementations any sealing surface may include additional features or characteristics, such as a taper, a groove, a recess, a protrusion, or curvature, for example. In various implementations, a characteristic, such as a taper, a groove, a recess, a protrusion, or curvature, may be accentuated, reduced, or removed from a sealing surface. Thus, a unitary multiple seal mechanism may be formed having a variety of sealing surfaces and may couple to a variety of sealing surfaces on other objects.

Although axial compression of tubular sealing member 210 was explained in reference to the example of FIG. 3, In various other implementations, cylindrical surfaces 148, 169 seal against inner surface 222 of tubular sealing member 210 without the radially-extending surfaces 159, 169 engaging or sealing against end faces 213, 217 of member 210. In such cases, for example, instead of member 210 experiencing axial compression from contact with surfaces 159, 169, member 210 may expand radially due to cylindrical surfaces 148, 169 having outside diameters equal or larger than the inside diameter of inner surface 222.

As a further example of possible modifications, in various implementations the boss 155 that surrounds nipple 145 on manifold 140 may be formed in another shape, such as square, rectangular, or oval for example, as viewed from the bottom relative to FIG. 3. Correspondingly, sealing surface 156 may have another shape, such as square, rectangular, or oval for example.

The above discussion is meant to be illustrative of the principles and various embodiments of the present invention. Numerous other variations and modifications will become apparent to those skilled in the art once the above disclosure is fully appreciated. It is intended that the following claims be interpreted to embrace all such variations and modifications.

What is claimed is:

1. A fluid delivery system comprising:

a manifold plate;

a housing vessel;

a fluid transfer mechanism; and a unitary multiple seal mechanism having a tubular sealing member that seals against the manifold plate and the fluid transfer mechanism and having a second sealing member that seals against the manifold plate and the housing vessel;

wherein the second sealing member is radially displaced from the tubular sealing member; and wherein the unitary multiple seal mechanism further comprises a flexible connection extending between the tubular sealing member and the second sealing member.

2. The fluid delivery system of claim 1 wherein the engagement of the unitary multiple seal mechanism with the manifold plate, the fluid transfer mechanism, and the housing vessel forms more than two mutually isolated fluid zones.

3. The fluid delivery system of claim 1 wherein the fluid transfer mechanism is contained in the housing vessel.

4. The fluid delivery system of claim 1 wherein the tubular sealing member comprises a longitudinal axis, a first end section, a second end section, an intermediate section disposed between the first and second end sections and having a smaller outside diameter than the first and second end sections, and a generally axial passage extending through the first end section, the intermediate section, and the second end section.

5. The fluid delivery system of claim 4 wherein the manifold plate comprises a first manifold sealing surface and a second manifold sealing surface;

the housing vessel comprises a housing sealing surface; and the fluid transfer mechanism comprises a mechanism sealing surface;

wherein the first manifold sealing surface and the mechanism sealing surface form a first pair of sealing surfaces and are engaged by the tubular sealing member; and wherein the second manifold sealing surface and the housing sealing surface form a second pair of sealing surfaces and are engaged by the second sealing member.

6. The fluid delivery system of claim 5 wherein the first and second pairs of sealing surfaces are generally planar; and wherein the first pair of sealing surfaces forms two face seals with two end surfaces of the tubular sealing member.

7. The fluid delivery system of claim 4 wherein the manifold plate and the fluid transfer mechanism engage the tubular sealing member; and wherein the manifold plate and the fluid transfer mechanism compress the tubular sealing member axially by ten to forty percent of the uncompressed length of the tubular sealing member.

8. The fluid delivery system of claim 1 wherein the fluid transfer mechanism functions at least in part as a pressure regulator in fluid communication with an image forming mechanism of a printer system.

9. A printer system comprising:

a fluid delivery system having a unitary multiple seal mechanism; and an image forming mechanism coupled to the fluid delivery system wherein the unitary multiple seal mechanism comprises:

a tubular sealing member having a longitudinal axis, a first end section; a second end section; an intermediate section disposed between the first and second end sections and having a smaller outside diameter than the first and second end sections; and a passage extending through the first end section, the intermediate section, and the second end section;

an annular sealing member radially displaced from the tubular sealing member; and a flexible connection extending between the tubular sealing member and the annular sealing member;

wherein the flexible connection is axially thinner than the annular sealing member.

10. The printer system of claim 9 wherein the fluid delivery system further comprises a manifold plate;

a housing vessel; and a fluid transfer mechanism;

wherein the tubular sealing member seals against the manifold plate and the fluid transfer mechanism; and wherein the annular sealing member seals against the manifold plate and the housing vessel.

11. A printer system comprising:

a fluid delivery system having a unitary multiple seal mechanism; an image forming mechanism coupled to the fluid delivery system, a manifold plate, a housing vessel, and a fluid transfer mechanism;

wherein the unitary multiple seal mechanism comprises:

a tubular sealing member having an longitudinal axis, a first end section; a second end section; an intermediate section disposed axially between the first and second end sections and having a smaller outside diameter than the first and second end sections; and a passage extending through the first end section, the intermediate section, and the second end section;

an annular sealing member radially displaced from the tubular sealing member; and a flexible connection extending between the tubular sealing member and the annular sealing member;

wherein the flexible connection is axially thinner than the annular sealing member;

wherein the manifold plate comprises a first nipple surface and a manifold sealing surface;

the housing vessel comprises a housing sealing surface; and the fluid transfer mechanism comprises a second nipple surface;

wherein the tubular sealing member engages the first nipple surface and the second nipple surface; and wherein the annular sealing member engages the manifold sealing surface and the housing sealing surface.

* * * * *